US012642296B1

(12) United States Patent
Snyder

(10) Patent No.: US 12,642,296 B1
(45) **Date of Patent: *Jun. 2, 2026**

(54) STORAGE CASE AND METHODS THEREOF

(71) Applicant: Asher R Solutions Inc., Brooklyn, NY (US)

(72) Inventor: Asher Snyder, Brooklyn, NY (US)

(73) Assignee: Asher R. Solutions Inc., Brooklyn, NY (US)

( * ) Notice: Subject to any disclaimer, the term of this patent is extended or adjusted under 35 U.S.C. 154(b) by 26 days.

This patent is subject to a terminal disclaimer.

(21) Appl. No.: 18/595,409

(22) Filed: Mar. 4, 2024

Related U.S. Application Data

(63) Continuation-in-part of application No. 15/931,582, filed on May 13, 2020, now Pat. No. 11,918,040.

(60) Provisional application No. 62/847,244, filed on May 13, 2019.

(51) Int. Cl.

| | |
|---|---|
| ***A24F 15/00*** | (2020.01) |
| ***A24F 1/02*** | (2006.01) |
| ***A24F 1/28*** | (2006.01) |
| ***A24F 5/00*** | (2006.01) |
| ***A24F 9/02*** | (2006.01) |
| ***A24F 9/10*** | (2006.01) |
| ***A24F 9/16*** | (2006.01) |
| ***A24F 23/00*** | (2006.01) |

(52) U.S. Cl.
CPC ..... *A24F 9/16* (2013.01); *A24F 1/02* (2013.01); *A24F 1/28* (2013.01); *A24F 5/00* (2013.01); *A24F 9/02* (2013.01); *A24F 9/10* (2013.01); *A24F 23/00* (2013.01)

(58) Field of Classification Search
CPC ..... A24F 15/12; A24F 15/18; A24F 15/01; A24F 15/02; A24F 1/26; A24F 23/04; A24F 1/00; A24F 40/95; B65D 25/04; B65D 43/16
USPC ..... 131/329; 206/256, 36, 242
See application file for complete search history.

(56) References Cited

U.S. PATENT DOCUMENTS

| | | | | |
|---|---|---|---|---|
| 1,519,261 | A * | 12/1924 | Ranney | A24F 9/08 131/243 |
| 5,465,738 | A * | 11/1995 | Rowland | A24F 23/04 206/256 |
| 7,717,259 | B2 * | 5/2010 | Hatton | A24F 15/18 206/86 |
| 8,584,842 | B2 * | 11/2013 | Fakhouri | A24F 15/18 206/256 |
| 2004/0216753 | A1 * | 11/2004 | Fox | A24F 19/10 131/242 |

* cited by examiner

*Primary Examiner* — King M Chu
(74) *Attorney, Agent, or Firm* — Kochka Law, LLC; Michael P. Kochka, Esq.

(57) ABSTRACT

A hand-held case is provided. In some embodiments, the hand-held case may include a central compartment defined by an outer wall, a top lid with a cover for covering the central compartment, the top lid movable from a closed position to an open position, a bottom lid for covering a bottom compartment, wherein the top lid attached to the wall with a hinge, and wherein when the top lid is in a closed position, the hinge sits flush against the outer wall.

18 Claims, 32 Drawing Sheets

500

500

500

572

570

500

STORAGE CASE AND METHODS THEREOF

CROSS-REFERENCE TO RELATED APPLICATIONS

The present application claims priority to U.S. patent application Ser. No. 15/931,582 entitled "STORAGE CASE AND METHODS THEREOF," filed May 13, 2020, which claims priority to U.S. Provisional Patent Application Ser. No. 62/847,244 entitled "STORAGE CASE AND METHODS THEREOF," filed May 13, 2019, the disclosures of which are incorporated herein by reference in their entirety as if fully set forth herein.

BACKGROUND

Embodiments of the present invention are generally related to a storage case and methods of utilizing the same. More specifically, embodiments of the present invention relate to an easily portable case that may comprise compartments and storage areas for items such as a ground herb, pipes, filter screens, multi-tools, and/or the like.

Various smokable herbs such as ground *cannabis*, tobacco, or the like, may be stored in various cases and containers. One such case may be referred to as a dugout. A dugout may refer to a hand-held box typically made of wood with two compartments. One compartment holds a pipe and a second compartment holds a limited amount of ground *cannabis*. In use, a user would slide open the dugout, pull out the pipe and pack it by pressing it into the compartment containing smokable herbs such as ground *cannabis*, or the like. Dugouts are popular because of their portability, relative discreetness, and level of easiness to use. They are still relatively thick though and not as easily portable as other items commonly carried in a user's pocket, such as a mobile phone, a portable music player, or the like.

SUMMARY

Embodiments of the present disclosure generally relate to a storage case and methods of utilizing the same. In some embodiments, a hand-held case may feature various applications. For example, a hand-held case may include a central compartment defined by an outer wall, a top lid with a cover for covering the central compartment, the top lid movable from a closed position to an open position, a bottom lid for covering a bottom compartment. In some embodiments, a storage case my include a central compartment defined by an outer wall, the central compartment sized to accept a smokable herb; a top lid comprising a cover for covering the central compartment, the top lid movable from a closed position to an open position; a bottom lid comprising a slidable cover for covering a bottom compartment; a tool compartment for storing a tool, the tool compartment disposed on a lateral side of the central compartment; and a pipe compartment for storing a pipe, the pipe compartment disposed on an opposite lateral side of the central compartment from the tool compartment, or the like.

BRIEF DESCRIPTION OF THE DRAWINGS

So the manner in which the above-recited features of the present invention can be understood in detail, a more particular description of embodiments of the present invention, briefly summarized above, may be had by reference to embodiments, which are illustrated in the appended drawings. It is to be noted, however, the appended drawings illustrate only typical embodiments of embodiments encompassed within the scope of the present invention, and, therefore, are not to be considered limiting, for the present invention may admit to other equally effective embodiments, wherein.

Figure 1:
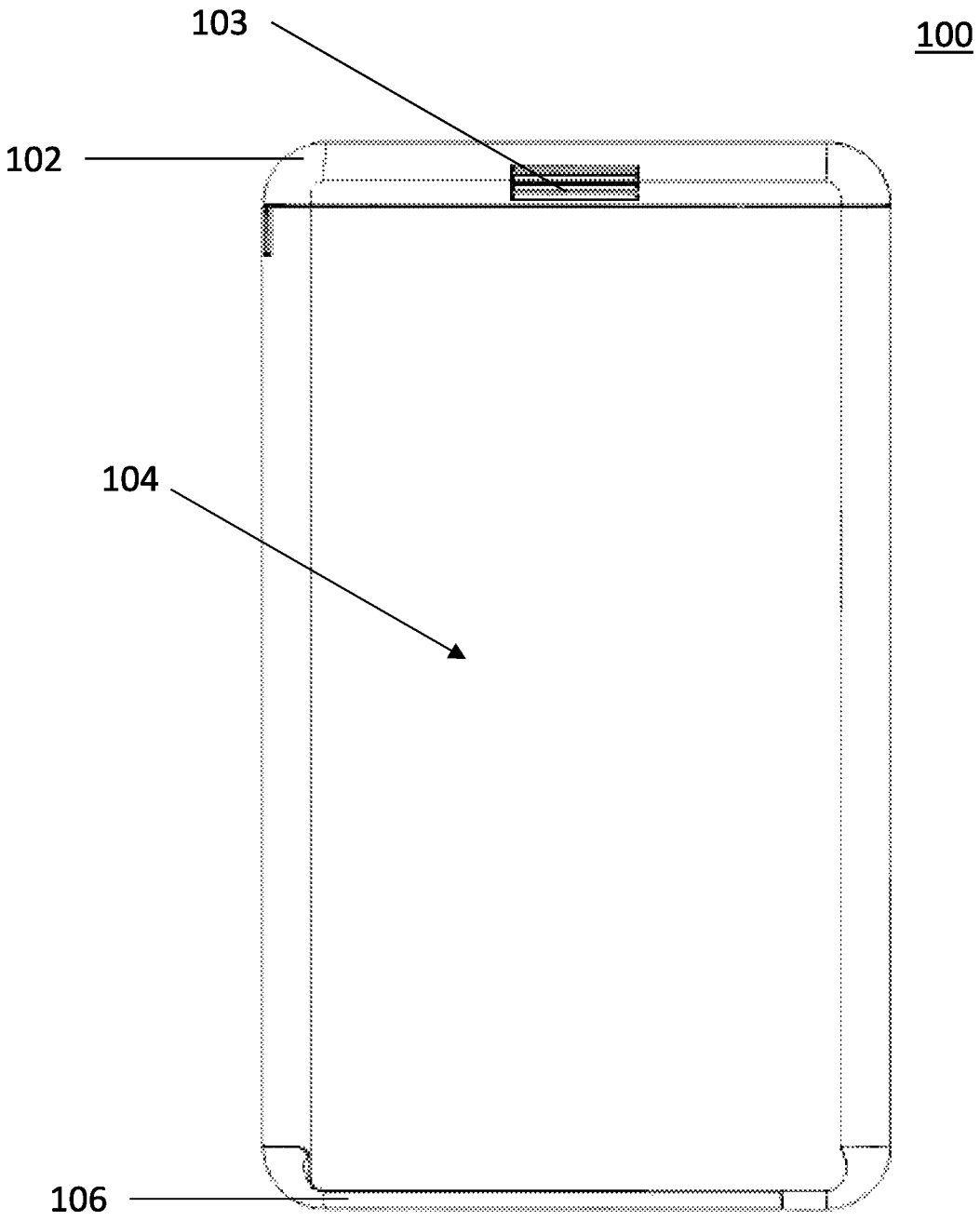
FIG. 1 depicts a front view of a case with a top lid in a closed position in accordance with embodiments of the present disclosure.
Figure 2:
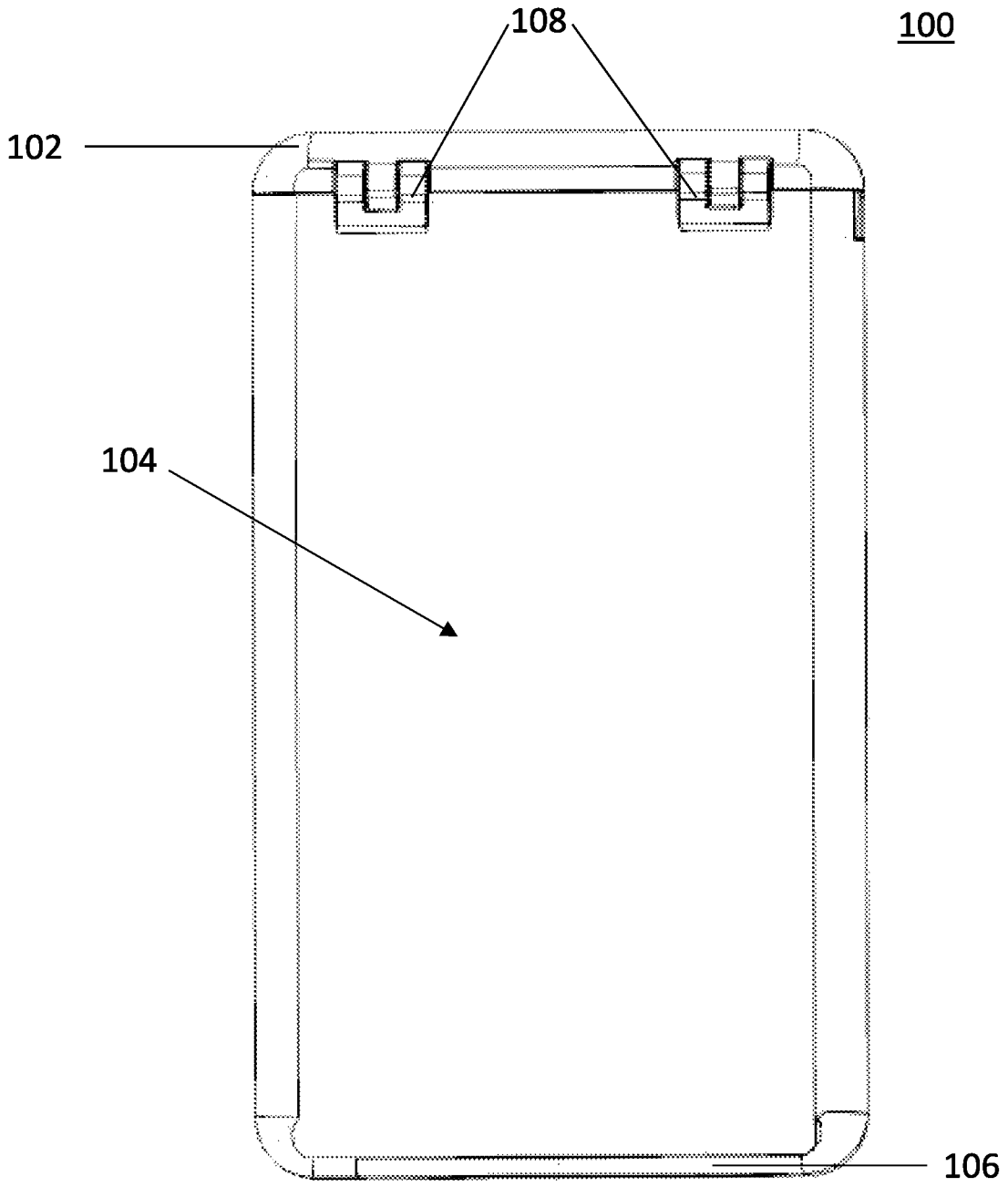
FIG. 2 depicts a back view of a case with a top lid in a closed position in accordance with embodiments of the present disclosure.
Figure 3:
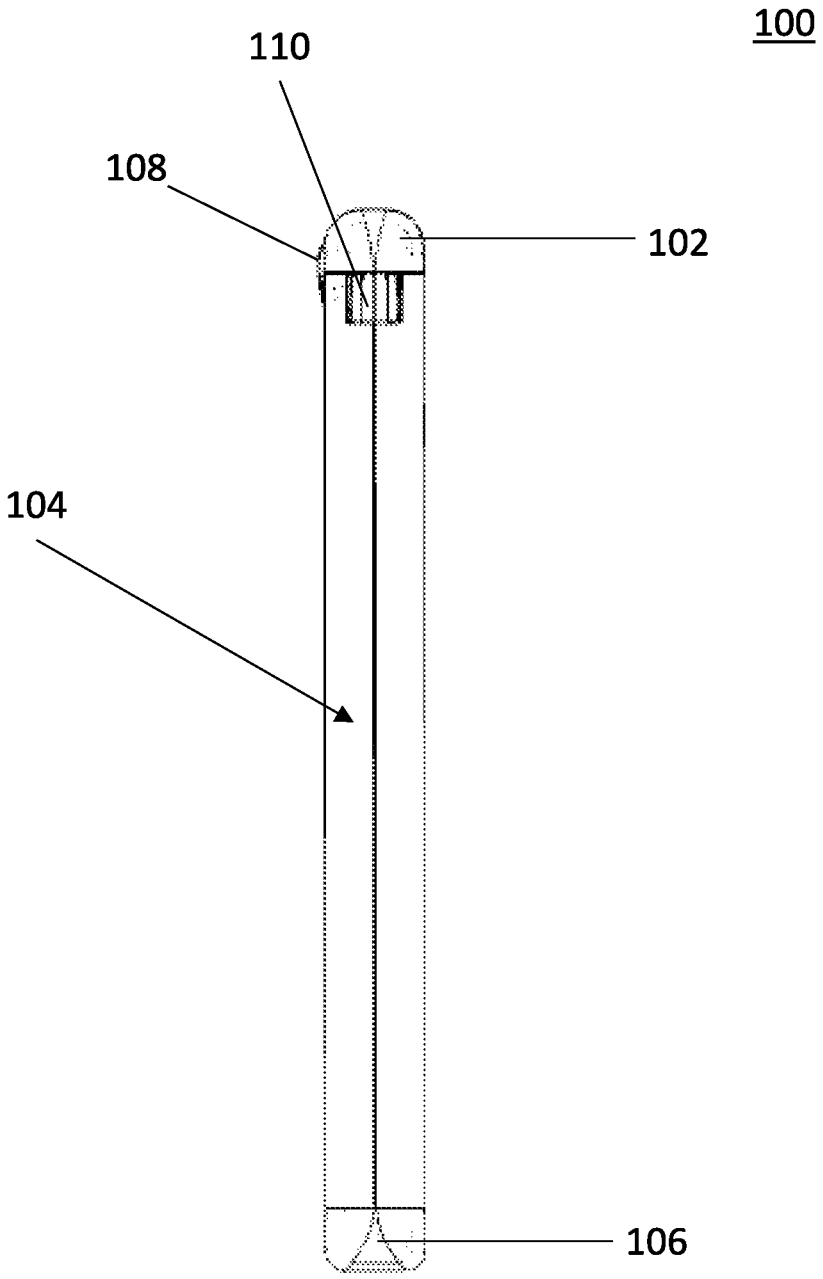
FIG. 3 depicts a left side view of a case with a top lid in a closed position in accordance with embodiments of the present disclosure.
Figure 4:
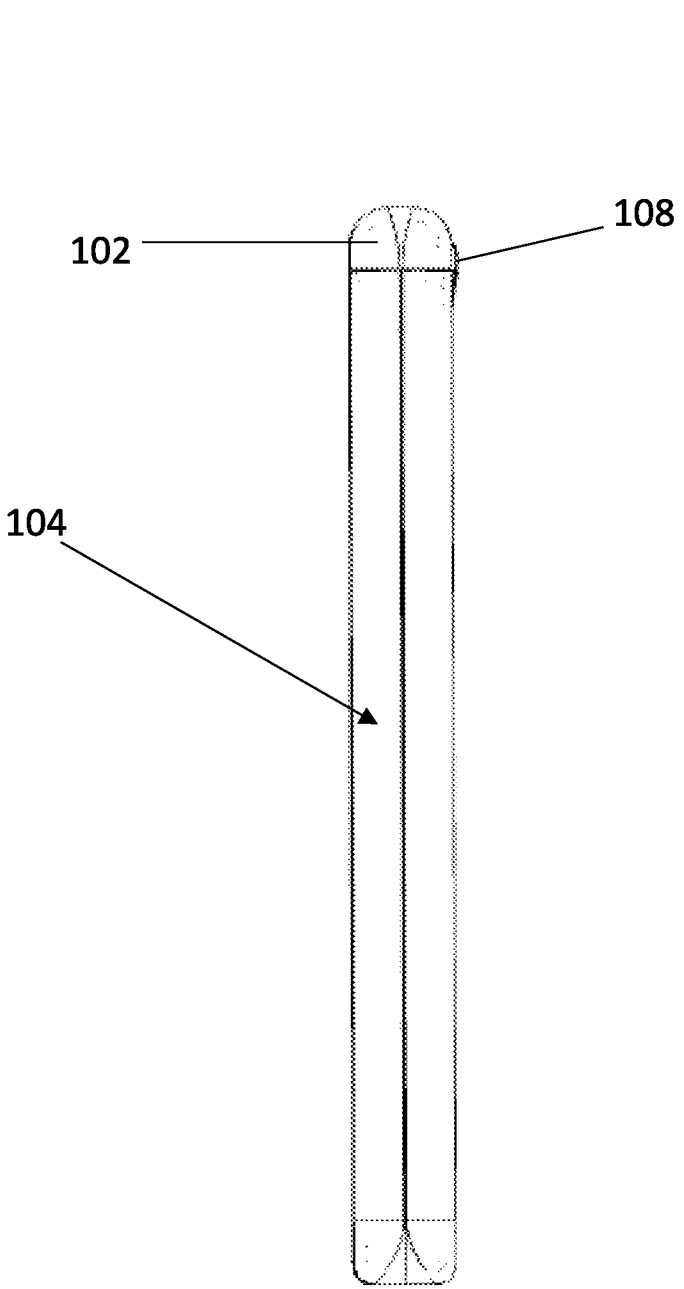
FIG. 4 depicts a right side view of a case with a top lid in a closed position in accordance with embodiments of the present disclosure.
Figure 5:
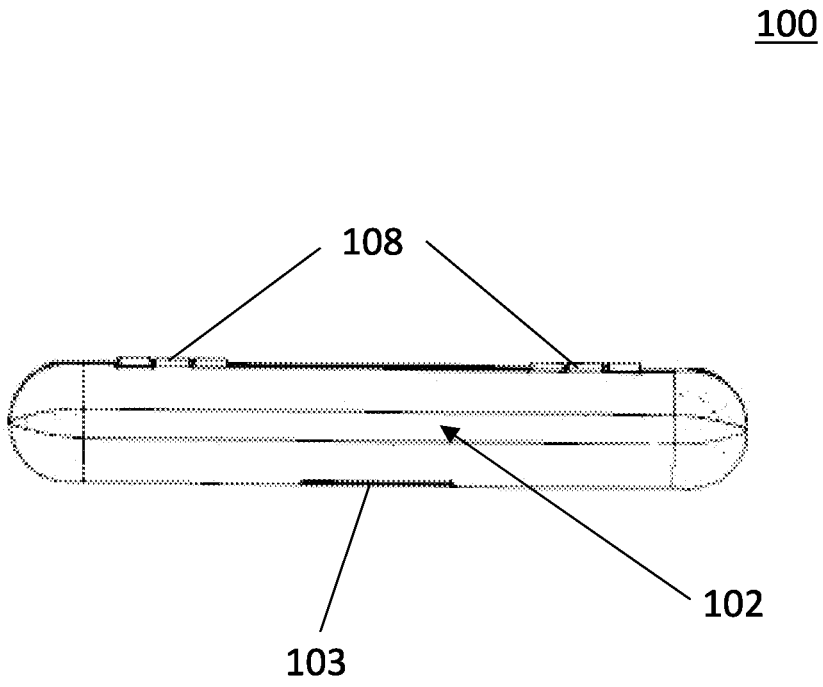
FIG. 5 depicts a top view of a case with a top lid in a closed position in accordance with embodiments of the present disclosure.
Figure 6:
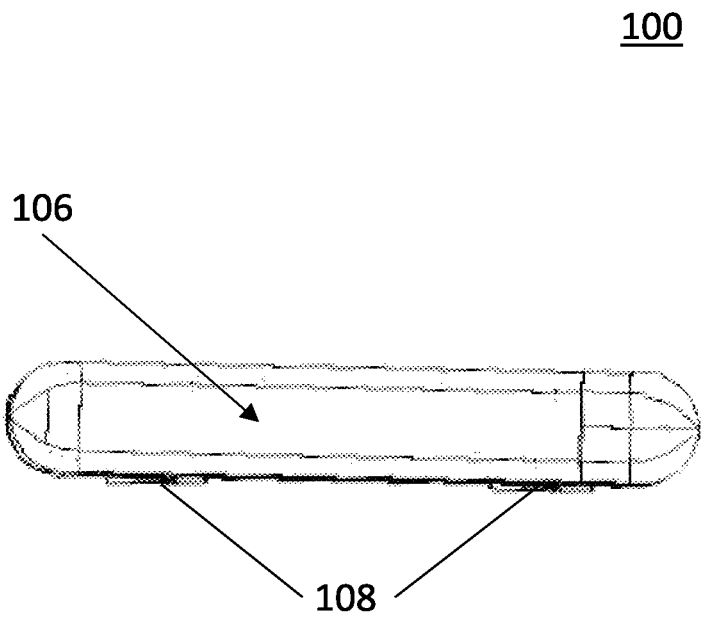
FIG. 6 depicts a bottom view of a case with a top lid in a closed position in accordance with embodiments of the present disclosure.
Figure 7:
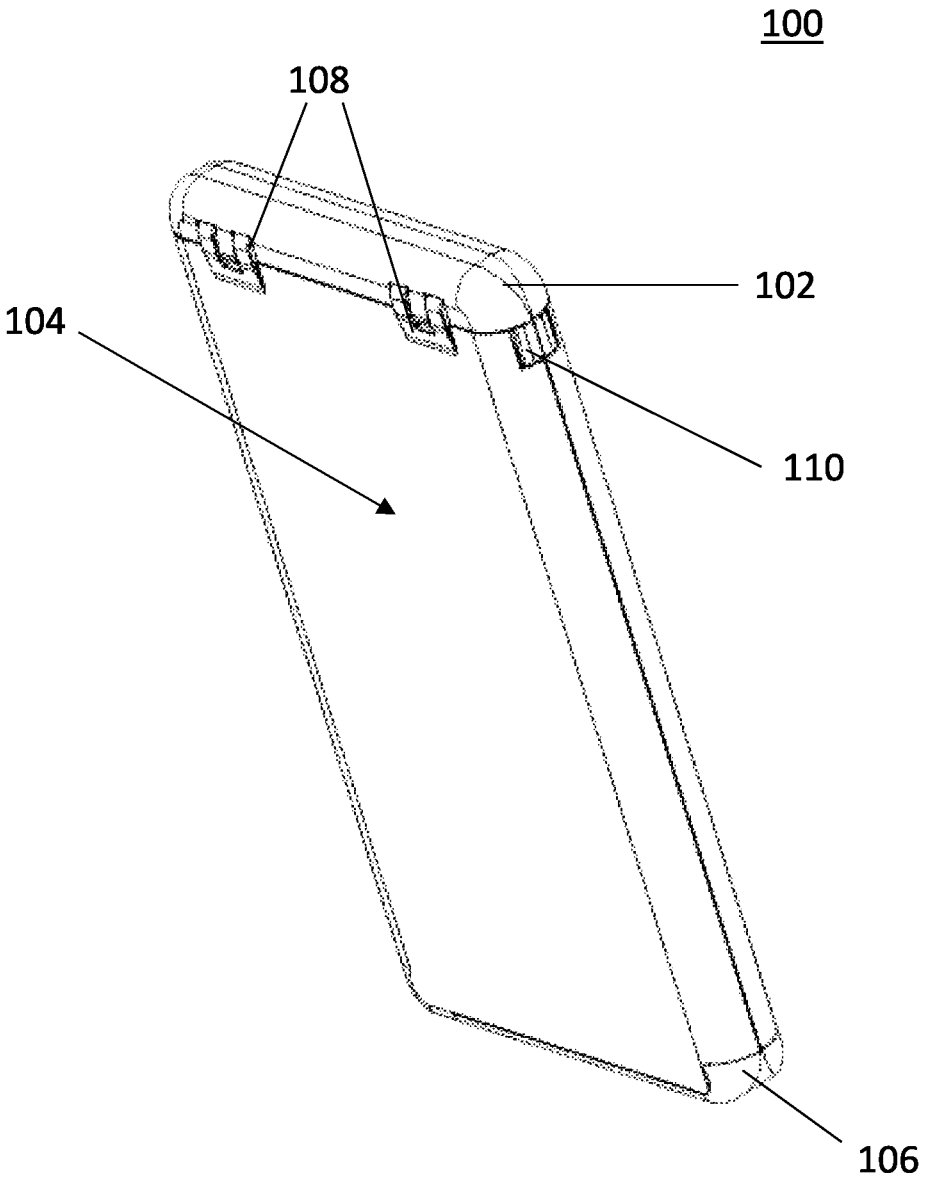
FIG. 7 depicts a back perspective view of a case with a top lid in a closed position in accordance with embodiments of the present disclosure.
Figure 8:
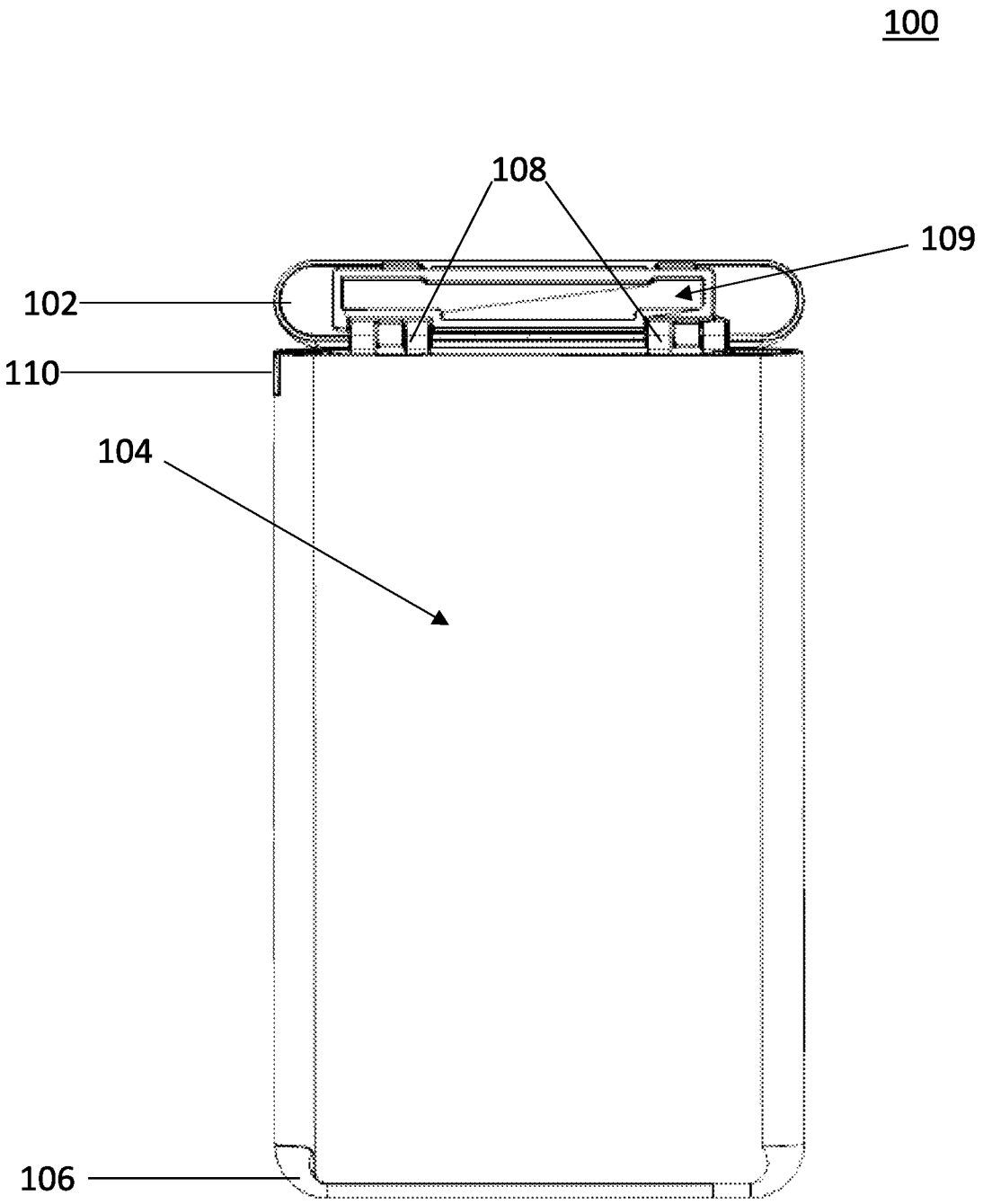
FIG. 8 depicts a front view of a case with a top lid in an open position in accordance with embodiments of the present disclosure.
Figure 9:
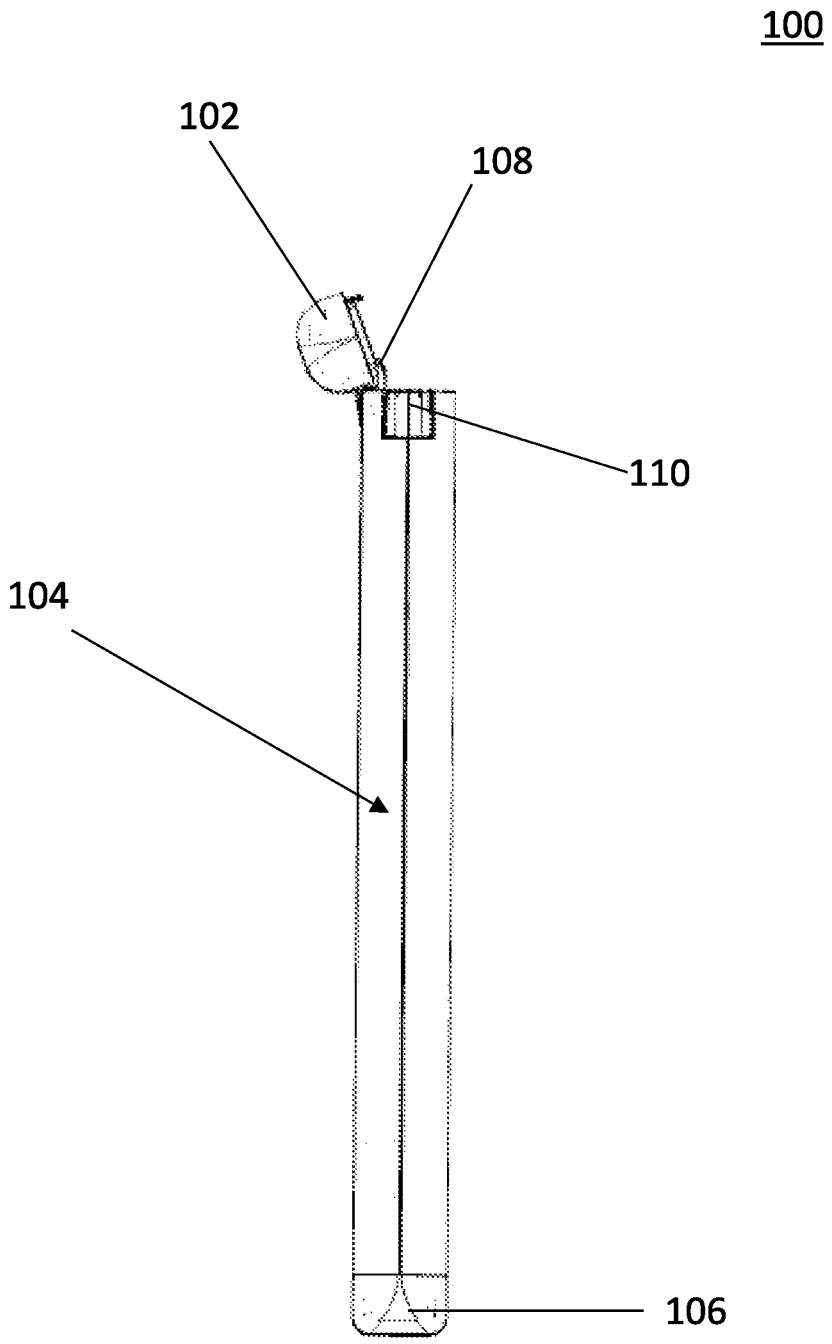
FIG. 9 depicts a left side view of a case with a top lid in an open position in accordance with embodiments of the present disclosure.
Figure 10:
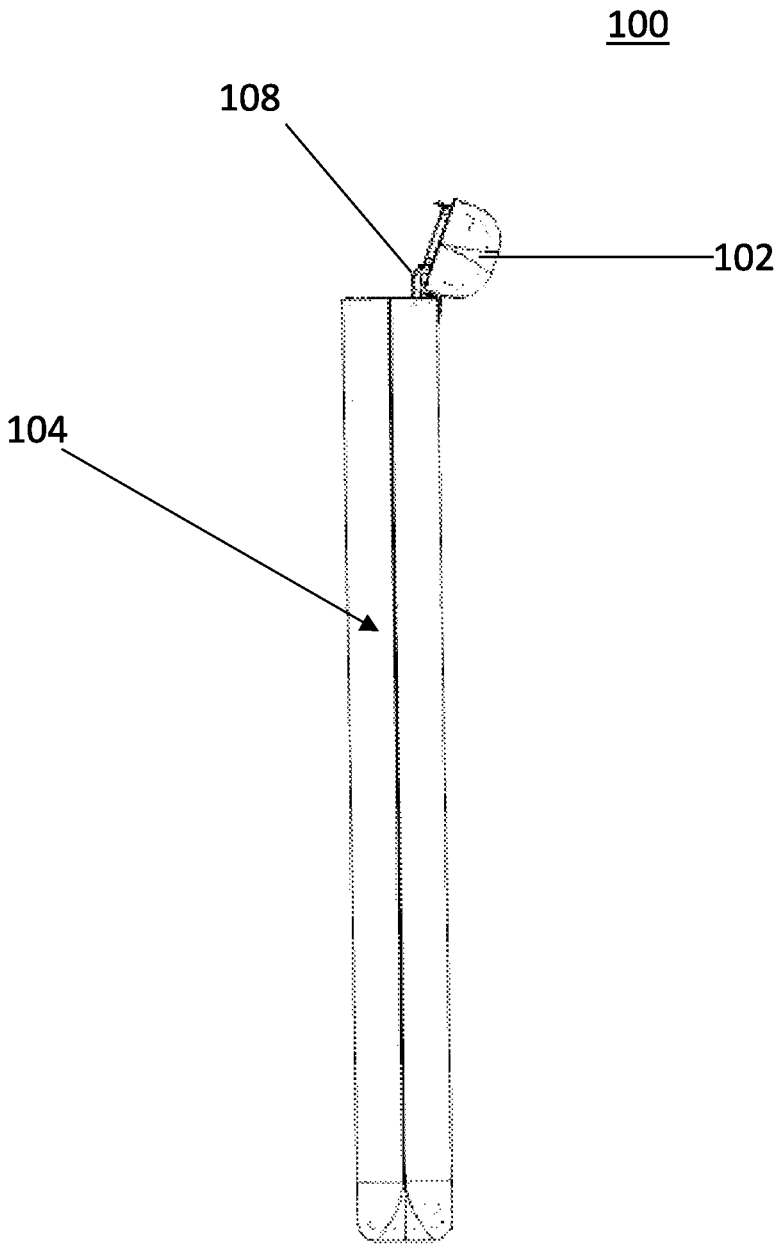
FIG. 10 depicts a right side view of a case with a top lid in an open position in accordance with embodiments of the present disclosure.
Figure 11:
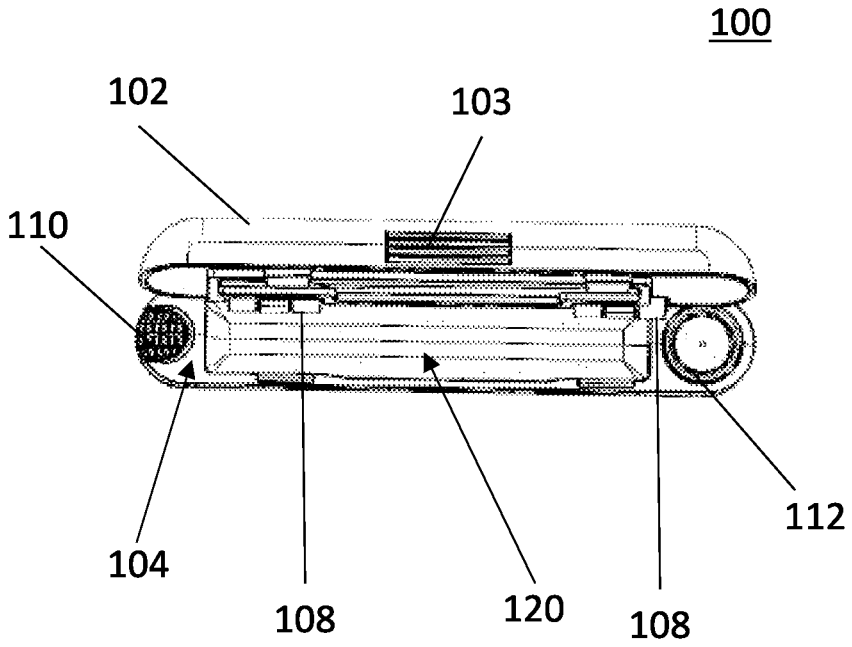
FIG. 11 depicts a top view of a case with a top lid in an open position holding a tool and a pipe in accordance with embodiments of the present disclosure.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, reference numerals have been used, where possible, to designate like elements common to the figures.

DETAILED DESCRIPTION

Embodiments of the present invention are generally related to a storage case and methods of utilizing the same. More specifically, embodiments of the present invention relate to an easily portable *cannabis* case that may comprise various compartments and storage areas for items such as pipes, filter screens, multi-tools, herbs, and/or the like.

As used herein, the term "*cannabis*," "marijuana," or "herb" may refer to a product of a *cannabis* plant or hemp plant, a flowering plant including the species (or subspecies) *Cannabis sativa, Cannabis ruderalis*, and *Cannabis indica*, or the like. The term "bud" may refer to the flower of the mature marijuana plant, or the like. Buds may include portions of the plant that a user may dry, grind up, and/or smoke, or the like. While embodiments disclosed herein are discussed with respect to storage and use of *cannabis*, the storage of other smokable herbs, plants, or substances such as tobacco, or the like, is contemplated by and within the present disclosure.

Embodiments of the present disclosure depicted in the figures include a storage case that is thinner and more easily portable than a dugout or similar cases. Embodiments of the present disclosure may include a thin case that is designed and configured to store herbs, pipe, filters, and a tool for packing and de-clumping smokable herb in a single portable unit.

Referring now to FIGS. 1-16, a storage case 100 in accordance with embodiments of the present disclosure is depicted. The storage case 100 may comprise an herb or central compartment 120, a bottom compartment 122, a top lid 102, a lid grip 103, an outer wall 104, hinges 108, a seal 109, a filer compartment 124, a bottom lid 106, a smoking device or pipe 112, and/or a tool or multi-tool 110.

A case 100 in accordance with embodiments of the present disclosure may comprise a slim and sleek design. The case may be made of stainless steel, although any suitable combination of rigid or semi-rigid material such as metals, polymers, ceramics, or composites is contemplated by and within embodiments of the present disclosure. A case 100 may comprise a metal with a shiny appearance on the exterior of the case. A case 100 may be made of quality sturdy components that are designed to resist breaking or damage with normal use. For example, a case 100 may comprise a lid with a hinge comprising a thickness to resist breaking when the case 100 is opened and closed, or the like.

In exemplary embodiments, a case 100, may present a multitude of remarkable features contributing to its efficacy and versatility. A solid stainless-steel construction may ensure durability and longevity, providing a reliable housing for the case's contents. The case 100 may have a slim or ultra-slim profile. For example, a case 100 may have a width ranging between 5-16 mm. A case may be specifically designed to be approximately 8 mm wide, or the like. The case 100 may be remarkably portable and easily manageable, akin to contemporary handheld gadgets like mobile phones, or the like.

In some embodiments, the case 100 may include a central compartment 120 encased by an outer wall 104 and tailored to accommodate various smokable herbs, such as ground *cannabis*, tobacco, and/or the like. The central compartment 120 may be configured in an oval shape or a rectangular shape, and may offer generous storage space, in some cases extending down more than 50% of the length of the case for optimal herb storage capacity. A tool compartment 114 and/or pipe compartment 116 may be positioned adjacent to the central compartment 120 on either side of the central compartment 120 and may each be meticulously designed for specific storage functionalities.

In some embodiments, a top lid 102 may feature a flip-top design complete with one or more hinges 108, thereby allowing a smooth transition from a closed to an open position and ensuring easy access to the central compartment 120, or the like. Hinges 108 may be constructed to be flat or substantially flat and flush with the rear wall of the case. Hinges 108 may be designed and shaped to minimize protrusion, lessening the risk of the case 100 snagging on fabric or something else when pulled from a pocket or otherwise transported, while also enhancing the case's sleek aesthetic. Furthermore, the top lid 102 may be affixed with a magnet, strategically positioned adjacent to the side wall when closed thereby securing the lid to the outer wall and maintaining a tight seal.

A seal 109, which may include a custom-fit elastomer, or the like, may ensure the interior of the central compartment 120 remains substantially airtight when sealed. The seal 109 may be engineered and sized to create a substantially impermeable seal. This seal, coupled with precision engineered hinges 108, may facilitate secure sealing while enabling effortless opening for the user. Additionally, a hook or latch may be incorporated to the top lid 102 to ensure closure. The seal 109, crafted from food-safe silicone or rubber, effectively prevents odors from escaping the case, maintaining freshness, and preventing odor dispersion. A bottom lid 106 may be a sliding cover that conceals a bottom compartment 122, offering supplementary storage space for additional accessories, such as filters for a pipe, or the like. A tool 110 may be adapted for scooping, compacting, and cleaning smokable herb from the central compartment and may be housed within a tool compartment 114. The tool compartment 114 may be strategically positioned on a lateral side of central compartment 120 for easy access.

A pipe 112 for smoking a smokable herb may be included. A pipe 112 may be curved and feature a tapered center for enhanced grip and ease of handling, or the like. A center portion of the pipe 112 may be narrower than the outer ends to enhance the grip for the user. A pipe 112 may be equipped with a filter slot or filter opening 128 for storing pipe filters 126, which are adapted to filter unwanted elements during the smoking process. Additionally, the case 100 a pipe compartment 116 may include a spring-loaded design that facilitates effortless retrieval of the pipe when the top lid is opened. The spring-loaded design may include a spring 118 in the base of the pipe compartment 116 that may push the pipe 112 upward and at least partially outward of the pipe compartment 116 so that it can be easily grabbed by a user when the top lid 102 is opened. The top lid 102 may push the pipe 112 downward within the pipe compartment and compress the spring 118 when the top lid 102 is in the closed position. When the top lid 102 is opened, the pipe 112 may raise out of the pipe compartment 116 because it is pushed up by the spring 118 or other suitable raising mechanism.

The case 100 may also include a filter compartment 124 that may be disposed on the bottom of the case 100. The filter compartment 124 may include several openings to accommodate several filters 126 for use with the pipe 112. Filters 126 may be sized to contain smokable herb and enhance the smoking experience by providing a filtered and smoother draw. A case 100 may offer a comprehensive solution for the storage and utilization of smokable herbs, all within a compact, portable design.

Figure 12:
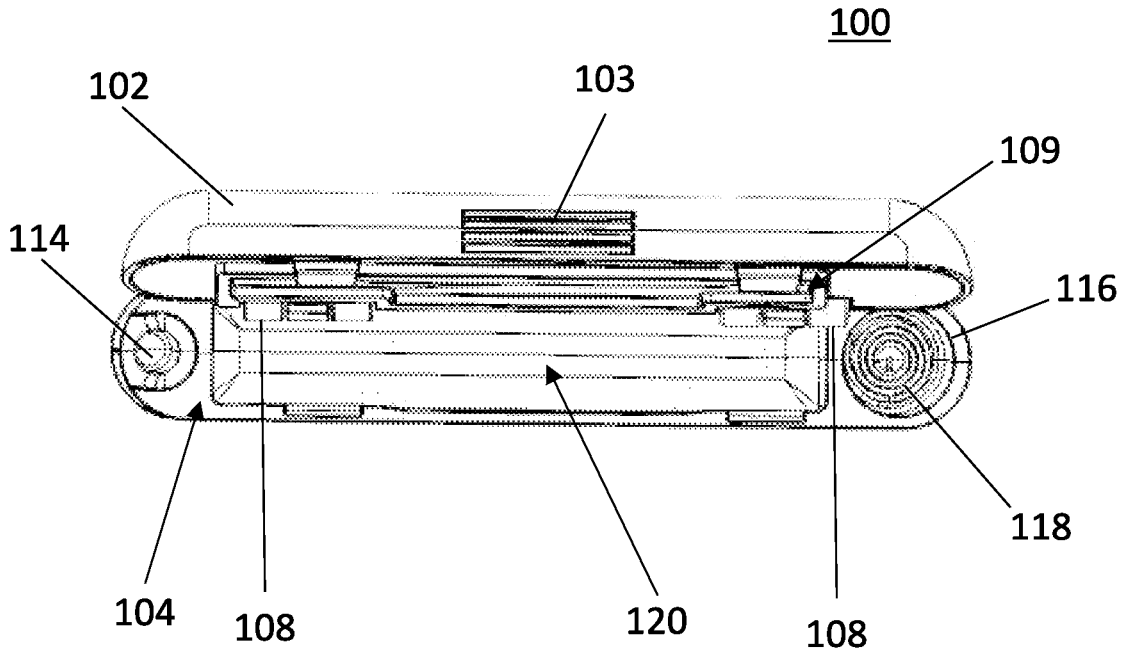
FIG. 12 depicts a top view of a case with a top lid in an open position without a tool and a pipe in accordance with embodiments of the present disclosure.
Figure 13:
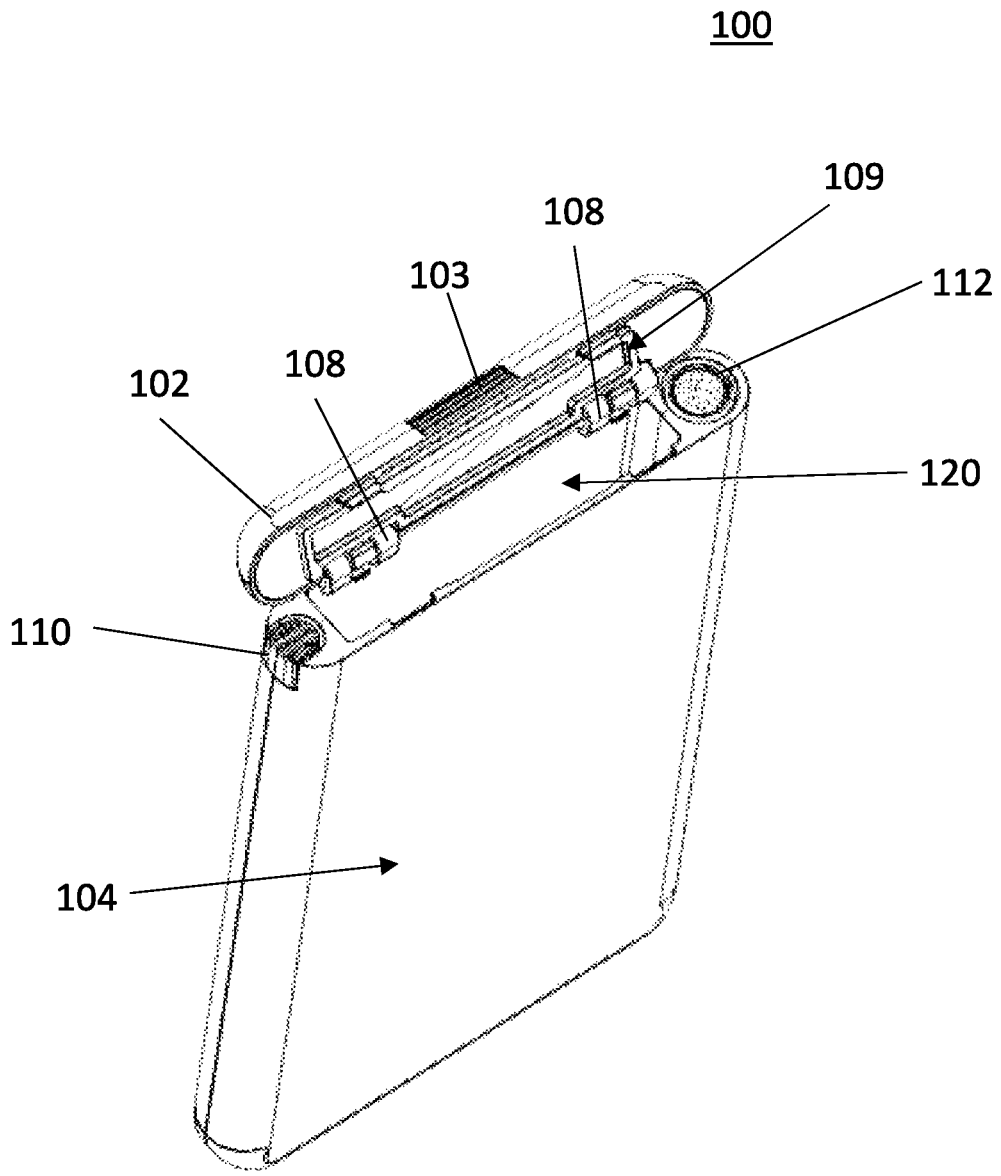
FIG. 13 depicts a front perspective view of a case with a top lid in an open position holding a tool and a pipe in accordance with embodiments of the present disclosure.
Figure 14:
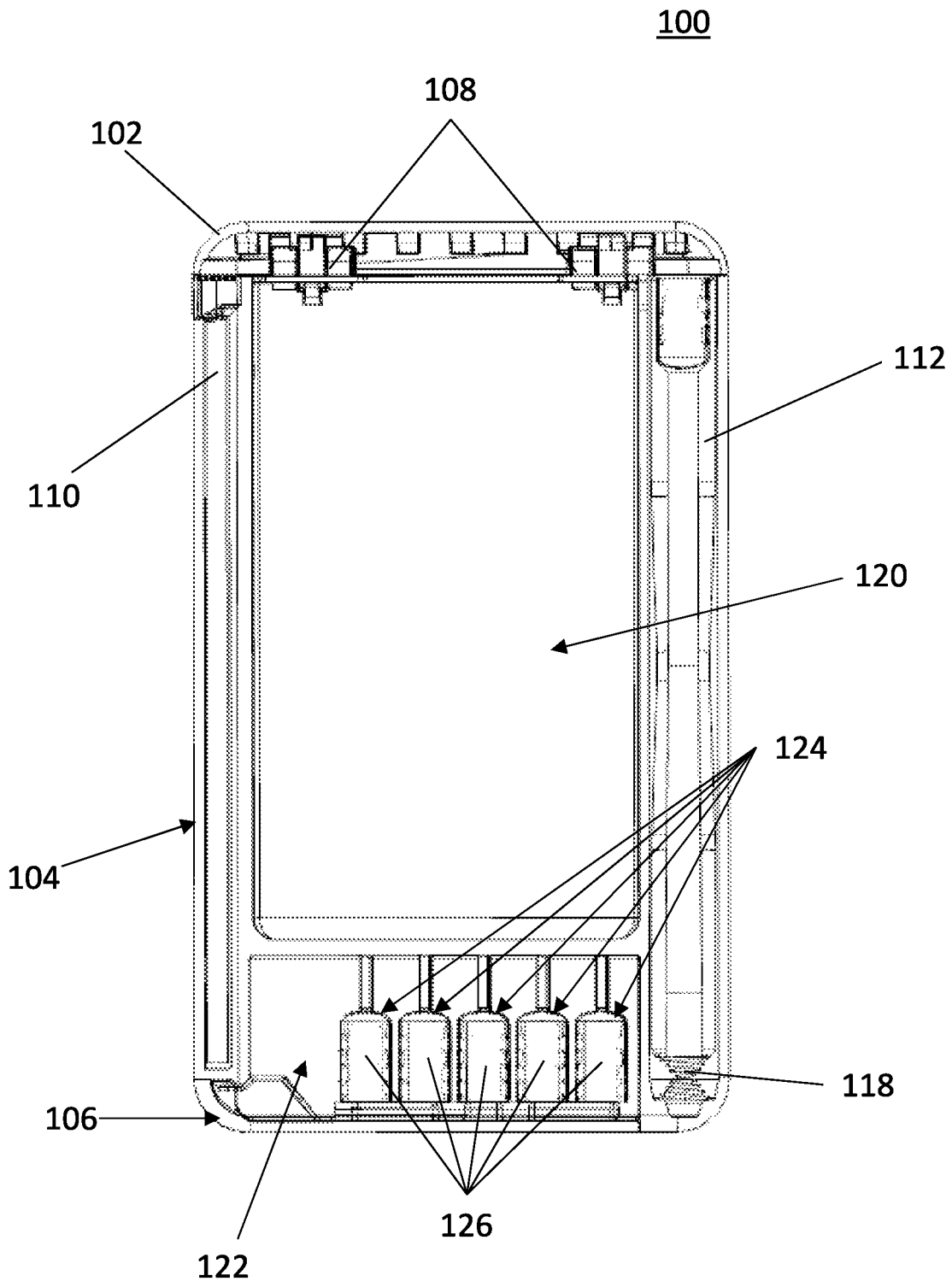
FIG. 14 depicts a front vertical cross-sectional view of a case with a top lid in a closed position in accordance with embodiments of the present disclosure.
Figure 15:
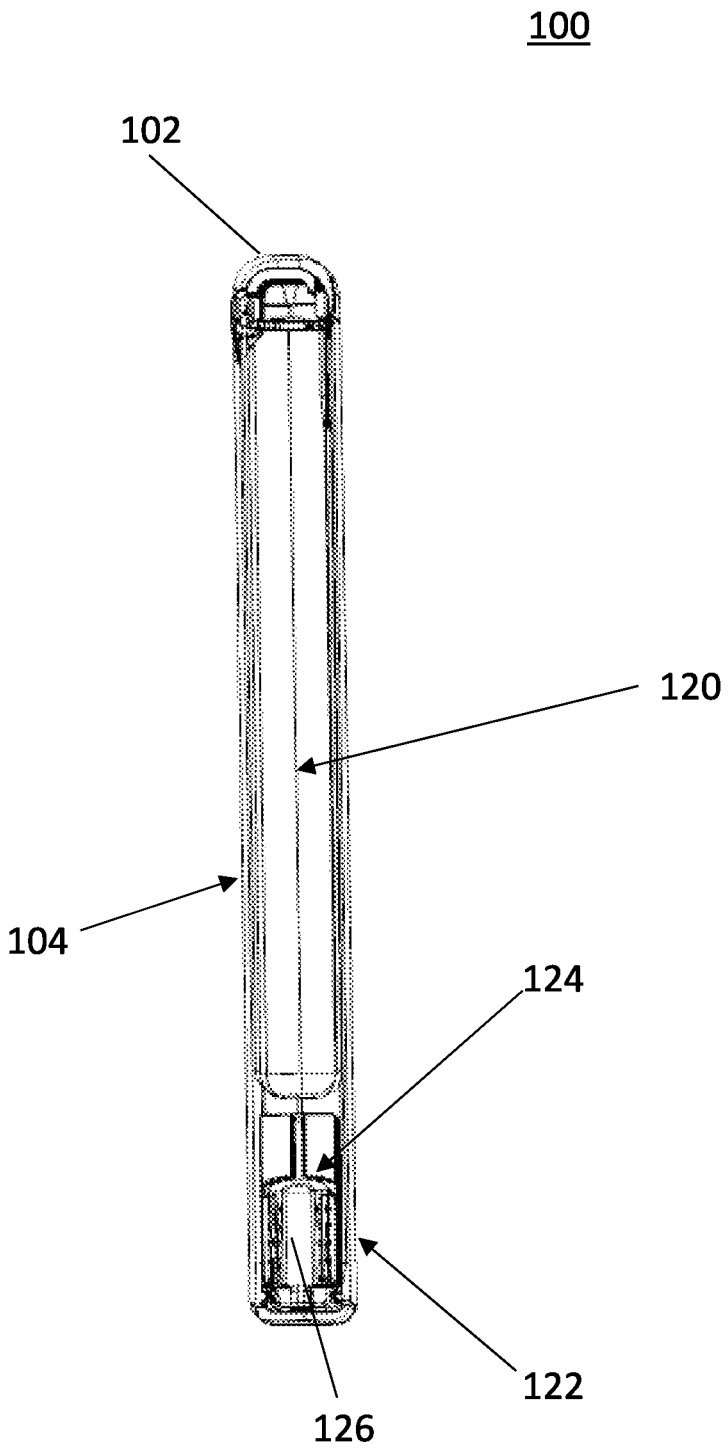
FIG. 15 depicts a side vertical cross-sectional view of a case with a top lid in a closed position in accordance with embodiments of the present disclosure.
Figure 16:
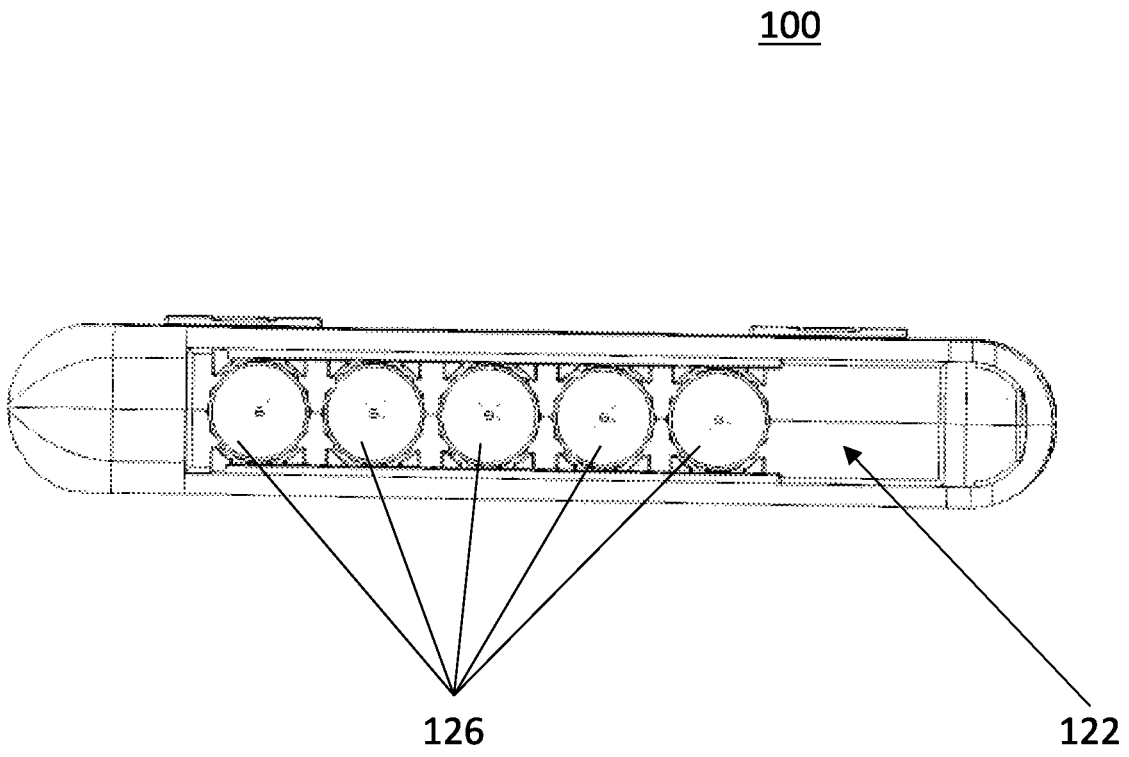
FIG. 16 depicts a bottom view of a case with a bottom lid removed in accordance with embodiments of the present disclosure.

Referring to FIG. 12, a case 100 is depicted with the pipe 112 and multi-tool 110 removed. The case 100 may comprise a tool compartment 114 for housing the multi-tool 110 and a pipe compartment 116. Referring to FIG. 14, a front vertical cross-sectional view of a case 100 with a top lid 102 in a closed position in accordance with embodiments of the present disclosure is shown. The case 100 may comprise a bottom compartment 122 and one or more pipe filter compartments 124 for housing pipe filters 126, or the like. The case 100 may be adapted to store and carry an amount of *cannabis*, which may be ground, or the like within the central compartment 120.

Figure 17:
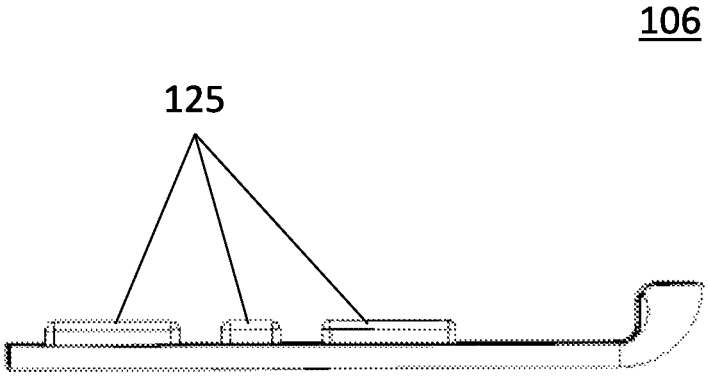
FIG. 17 depicts a side view of a bottom lid for a case in accordance with embodiments of the present disclosure.
Figure 18:
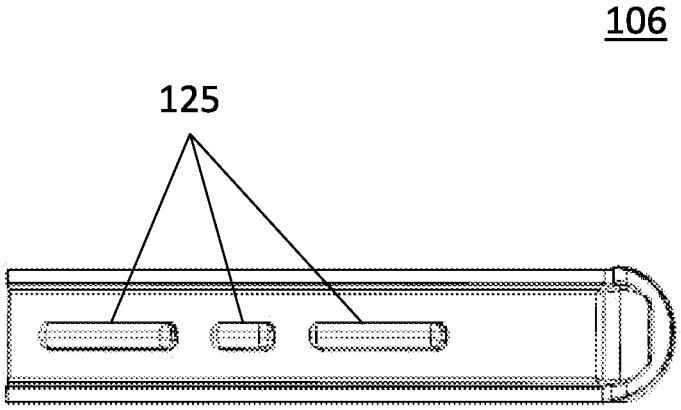
FIG. 18 depicts a top view of a bottom lid for a case in accordance with embodiments of the present disclosure.

FIGS. 17 and 18 depict a bottom lid 106 with a seal buffer 125 in accordance with embodiments of the present disclosure. A seal buffer 125 may be integrated within the bottom lid 106 or attached to the bottom lid 106 to enhance the security and protection of the contents of the bottom compartment and the filter compartment, such as one or more filters, or the like. Scal buffers 125 may be protrusions positioned on the inner surface of the lid, and may exert pressure on the contents within the case 100 when the bottom lid 125 is in the closed position to maintain the stability of the contents, such as the filters, and prevent shifting during storage and transit, or the like.

Figure 19:
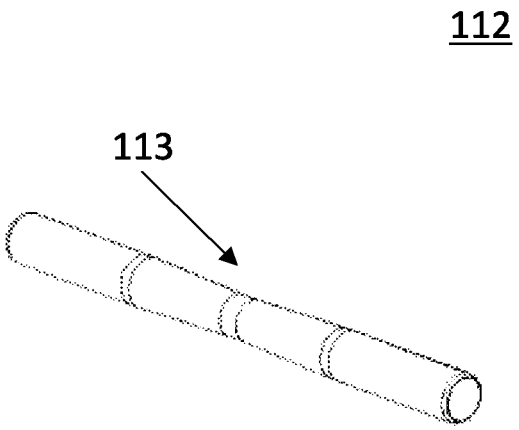
FIG. 19 depicts a perspective view of a pipe for a case in accordance with embodiments of the present disclosure.
Figure 20:
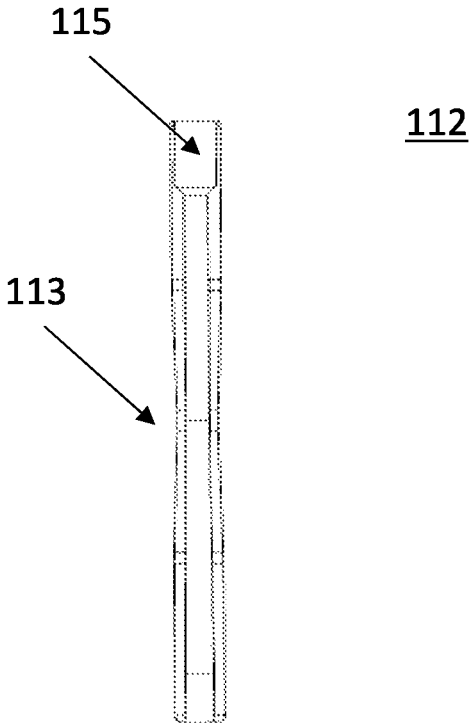
FIG. 20 depicts a cross-sectional vertical view of a pipe for a case in accordance with embodiments of the present disclosure.

Structurally, a seal buffer 125 may include various forms to accommodate different case 100 designs. It may consist of one or more raised ridges of varying lengths extending along the inner perimeter of the lid. In some embodiments, seal buffers 125 may be a series of strategically placed bumps or nodules, or a continuous strip of resilient material such as rubber or silicone adhered to the inner circumference of the lid. During operation, when the lid is closed, seal buffer 125 may create a protective buffer between the lid and the contents of the case 100. This buffer effectively absorbs external pressure and impacts, safeguarding the contents from damage. Additionally, seal buffer 125 may ensure a tight seal when the bottom lid 106 is secured shut, thereby preserving the integrity of the stored items. FIGS. 19 and 20 depict an exemplary pipe 112 comprising a tapered portion 113 and a pipe filter slot 115. The interior portion of the pipe 112 may comprise a straight tube structure and the exterior layer may be curved and tapered.

Figure 21:
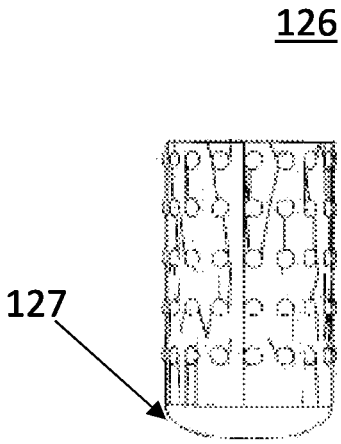
FIG. 21 depicts a side view of a filter for a case in accordance with embodiments of the present disclosure.
Figure 22:
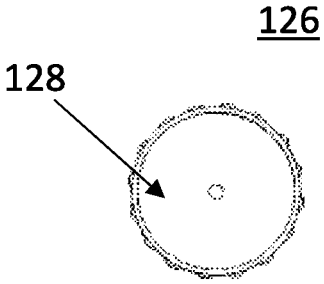
FIG. 22 depicts a side view of a filter for a case in accordance with embodiments of the present disclosure.

FIGS. 21 and 22 depict a pipe filter 126 comprising a rounded bottom 127 and apertures for filtering. In some embodiments the filter 126 has a cylindrical shape with an opening at one end tapering to a rounded bottom at the other end. The filter 126 may be made of a material resistant to damage, such as metal or a suitable alternative, and may be designed to fit snugly into the opening of a pipe or smoking device. The shape of the filter 126 allows for easy insertion into the pipe and a secure fit within the pipe while also promoting an uninterrupted airflow that results in a smooth and enjoyable smoking experience for the user. The filter 126 may comprise apertures dispersed over its surface, such as a mesh or perforated material designed to trap unwanted particles and impurities present in the smoke. This mesh, perforated material, and/or the like acts as a barrier, effectively filtering out undesirable elements while allowing the desired smoke to pass through unhindered. The opening may allow the user to insert smokable herb or other substances into the filter. Once inserted, the filter may securely store the material in place. The structure of a filter 126 may be designed to enhance the smoking experience by providing effective filtration while maintaining case of use.

Figure 23:
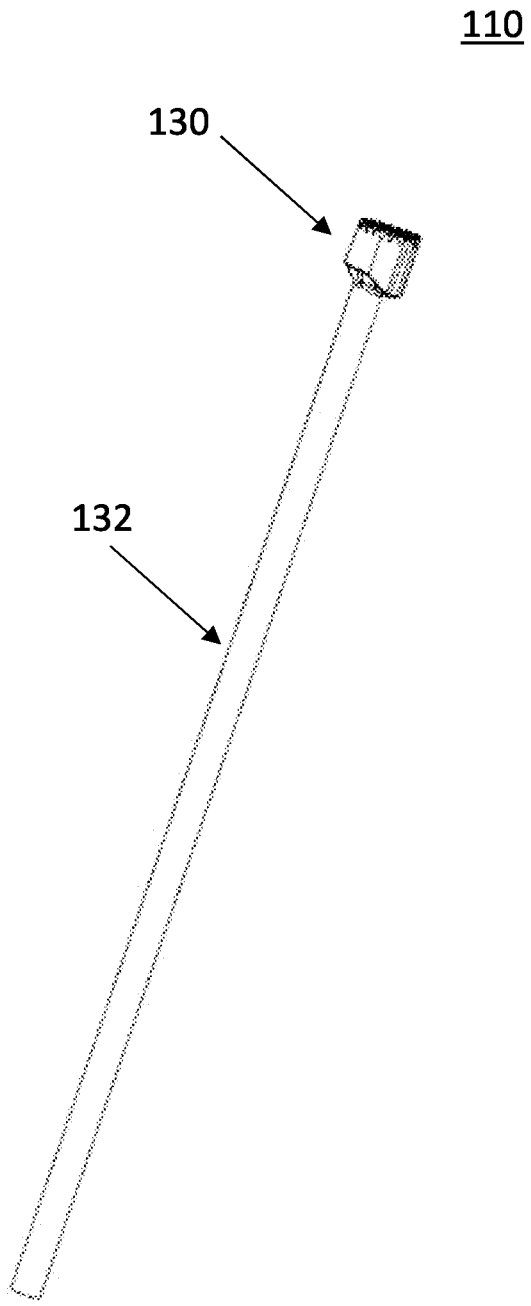
FIG. 23 depicts a perspective view of a tool for a case in accordance with embodiments of the present disclosure.
Figure 24:
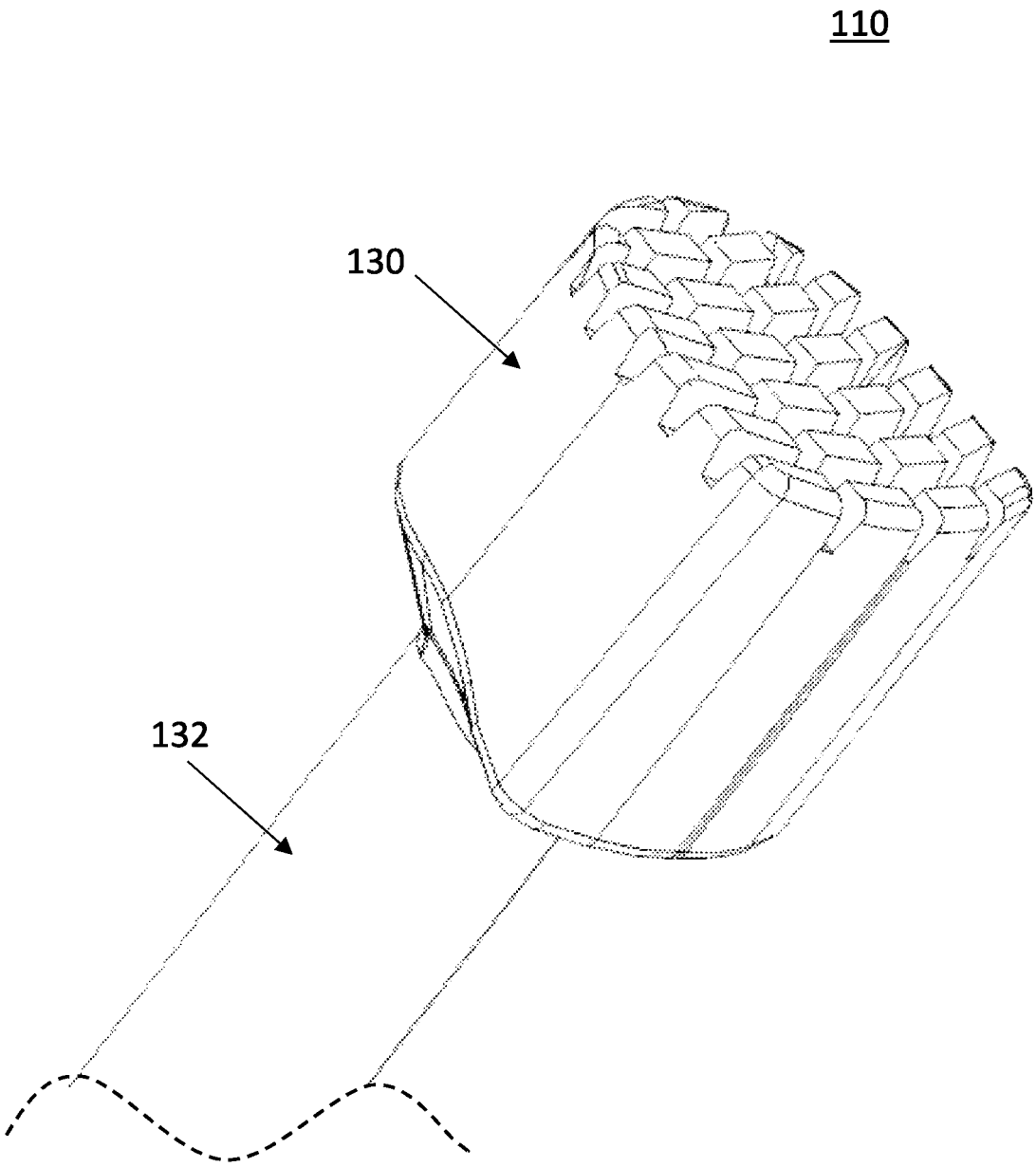
FIG. 24 depicts a perspective view of a top portion of a tool for a case in accordance with embodiments of the present disclosure.
Figure 25A:
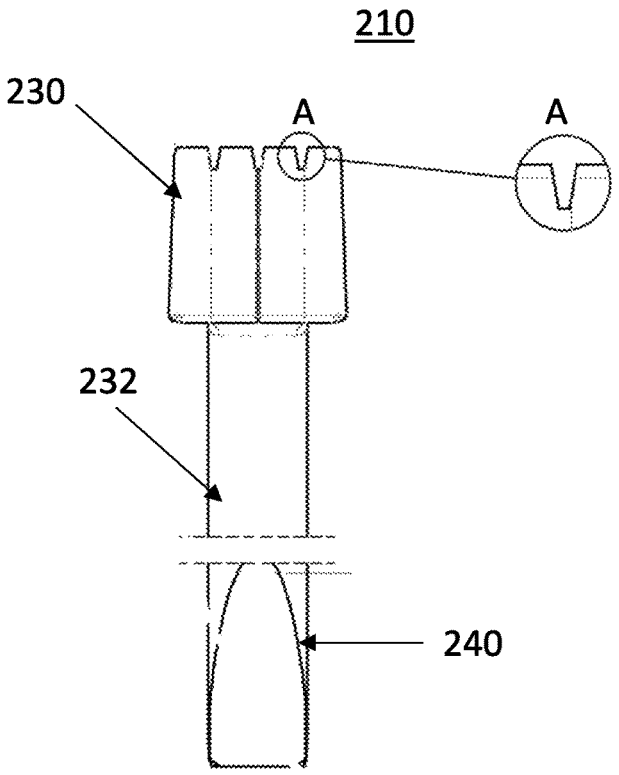
FIG. 25A depicts a front view of a tool for a case in accordance with embodiments of the present disclosure.
Figure 25B:
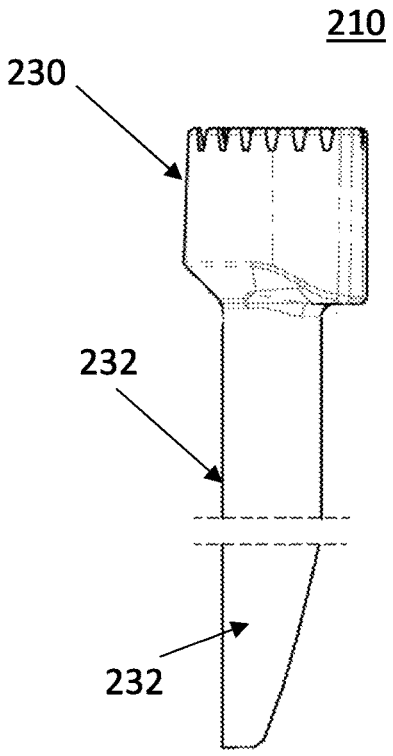
FIG. 25B depicts a side view of a tool for a case in accordance with embodiments of the present disclosure.

FIGS. 23-24 depict a multi-tool 110 comprising a tool head 130 and a tool plunger 132. The dotted line in FIG. 24 is intended to indicate the tool plunger 132 may have various lengths. FIGS. 25A and 25B depict a multi-tool 210 comprising a tool head 230, a tool plunger 232, and a tool shovel 240. The dotted lines in FIGS. 25A and 25B are included to show the length of the plunger 232 may vary, but generally may be sized to fit within the case 100. The tool head 230 may comprise one or more teeth separated by gaps A. The teeth may be used to compact a smokable herp and/or scrape it from the pipe 112 and/or the case 100. The tool shovel 240 may be used to scoop up smokable herb from the central compartment 120 and place it in a filter 126 of a pipe 112, and/or the like.

Figure 26:
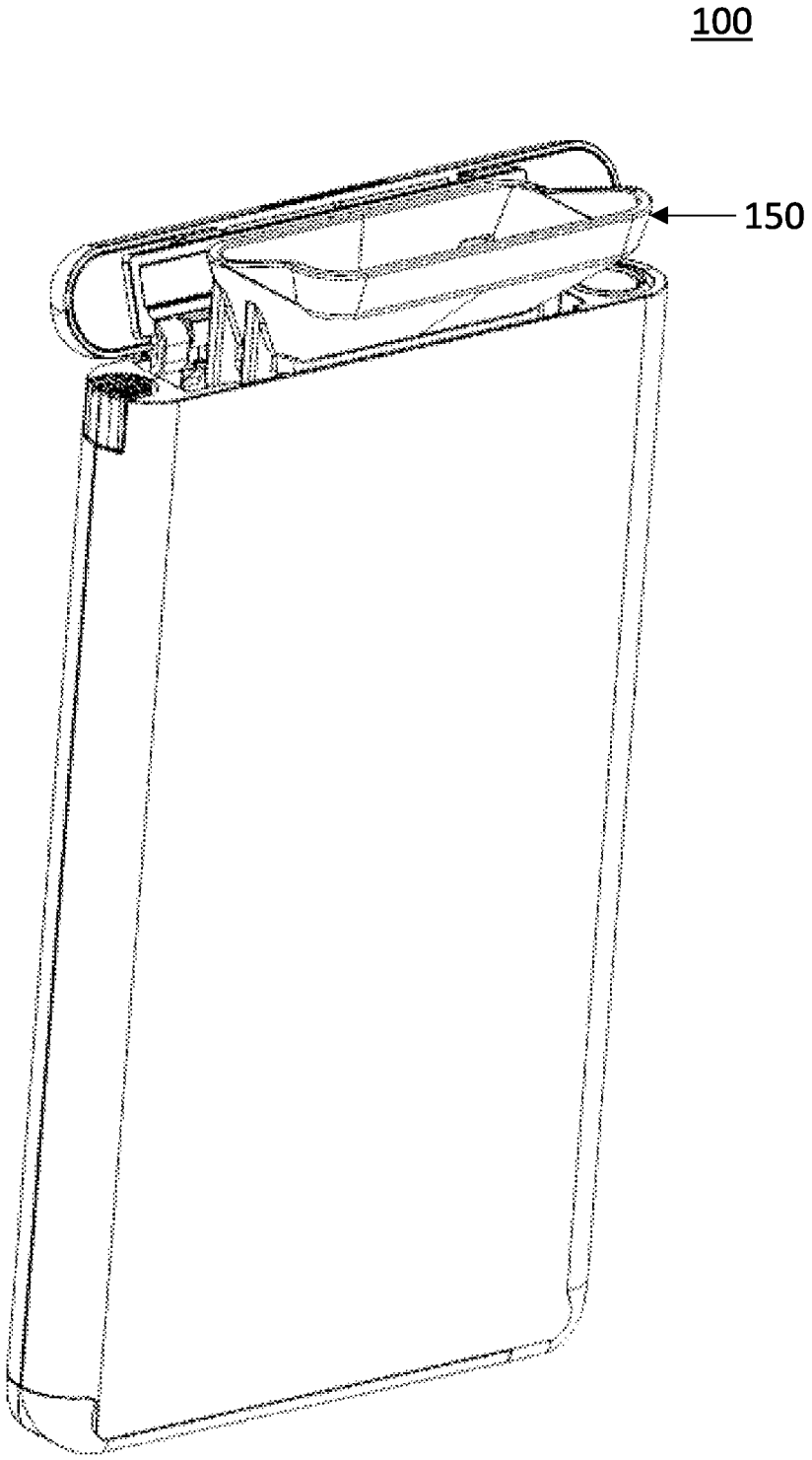
FIG. 26 depicts a perspective view of a funnel and a case in accordance with embodiments of the present disclosure.
Figure 27:
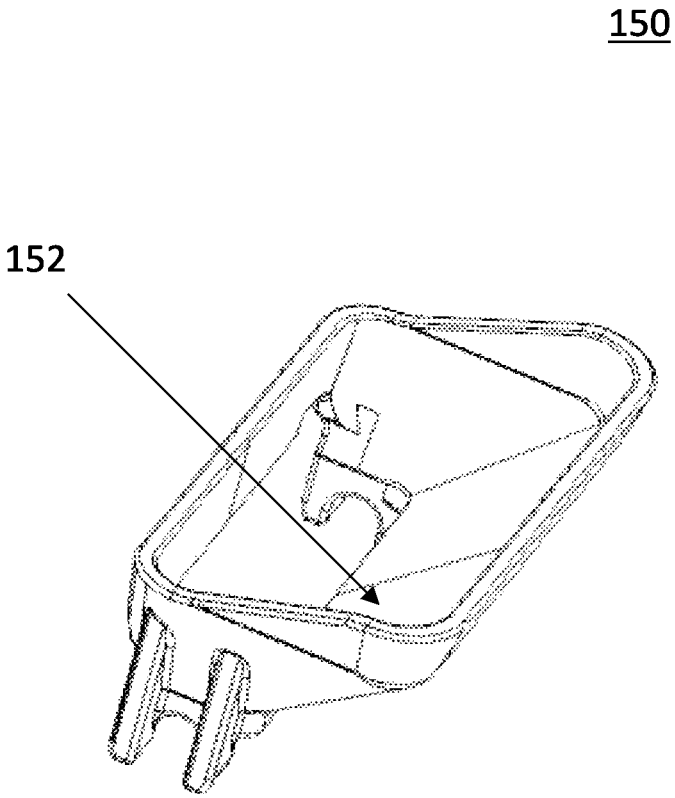
FIG. 27 depicts a perspective view of a funnel for a case in accordance with embodiments of the present disclosure.
Figure 28J:
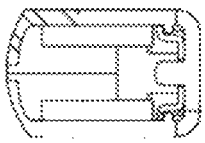
FIGS. 28A-N depict views of a case in accordance with embodiments of the present disclosure.
Figure 28K:
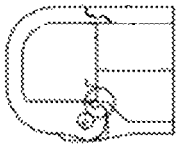
Figure 28L:
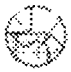
Figure 28N:
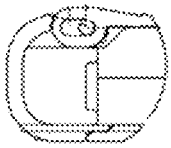
Figure 28H:
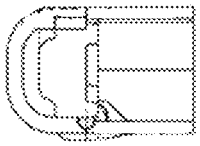
Figure 28I:
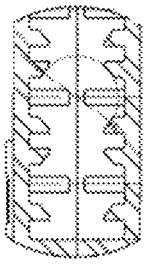
Figure 28G:
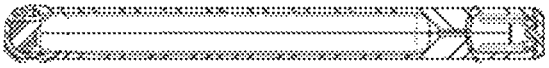
Figure 28D:
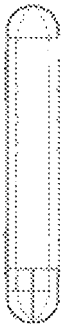
Figure 28E:
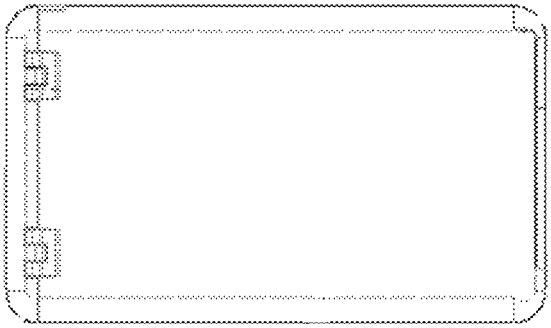
Figure 28F:
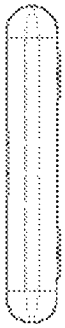
Figure 28M:
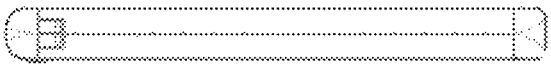
Figure 28A:
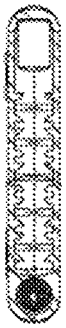
Figure 28B:
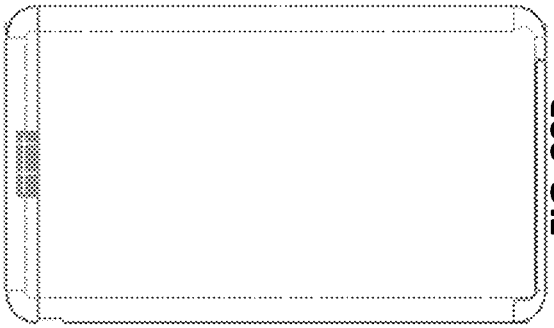
Figure 28C:
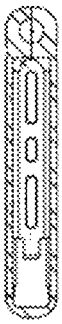
Figure 29J:
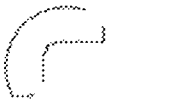
FIGS. 29A-M depict views of a case in accordance with embodiments of the present disclosure.
Figure 29K:
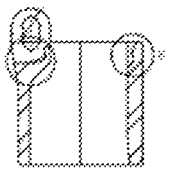
Figure 29L:
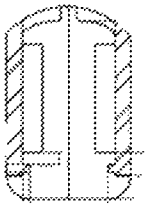
Figure 29G:
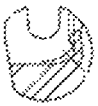
Figure 29M:
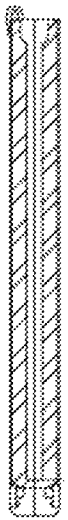
Figure 29I:
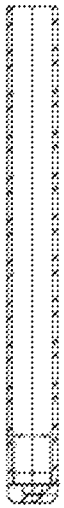
Figure 29F:
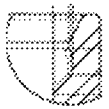
Figure 29H:
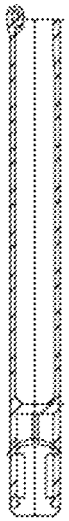
Figure 29E:
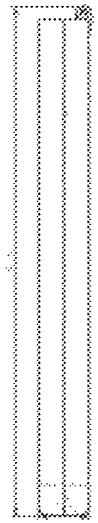
Figure 29B:
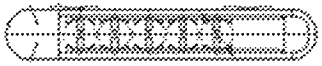
Figure 29C:
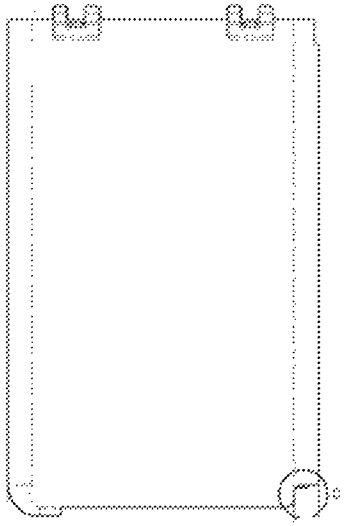
Figure 29D:
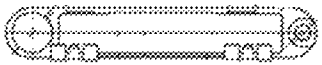
Figure 29A:
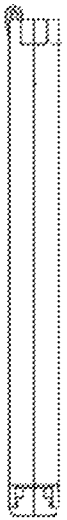
Figure 30A:
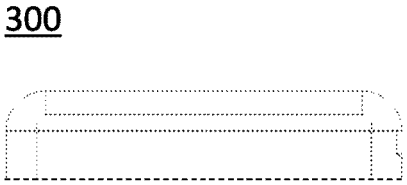
FIGS. 30A-D depict views of portion of a case in accordance with embodiments of the present disclosure.
Figure 30B:
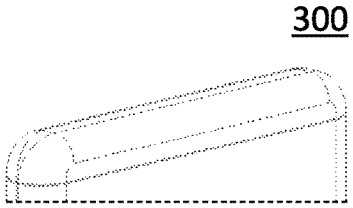
Figure 30C:
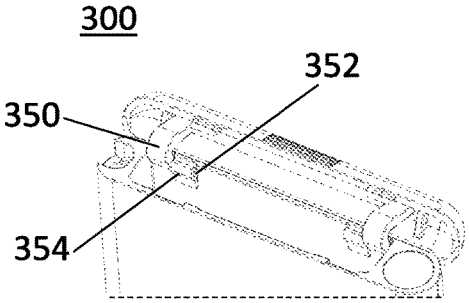
Figure 30D:
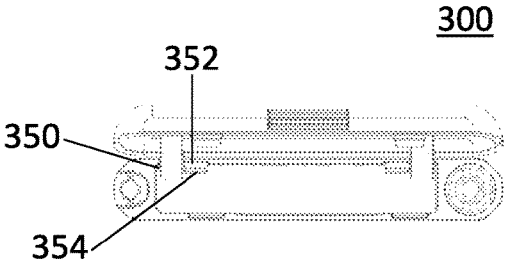
Figure 31A:
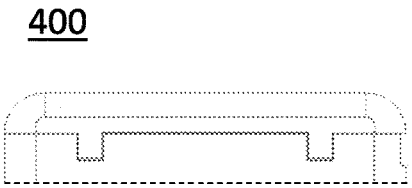
FIGS. 31A-D depict views of portion of a case in accordance with embodiments of the present disclosure.
Figure 31B:
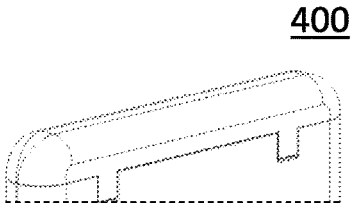
Figure 31C:
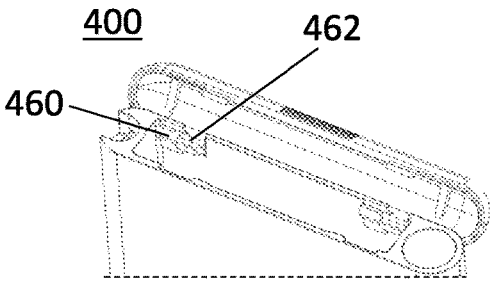
Figure 31D:
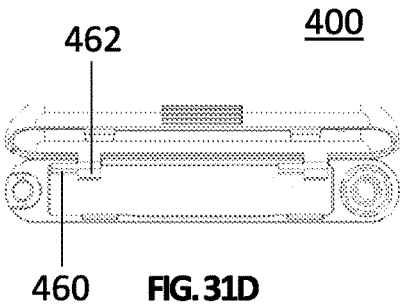
Figure 32A:
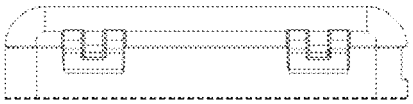
FIGS. 32A-D depict views of portion of a case in accordance with embodiments of the present disclosure.
Figure 32B:
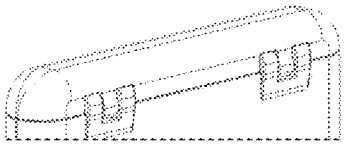
Figure 32C:
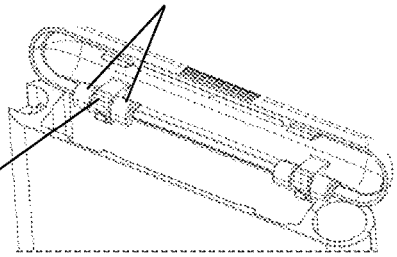
Figure 32D:
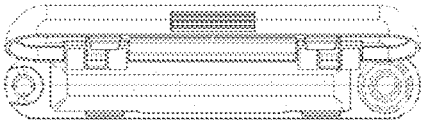

FIGS. 26 and 27 may depict a case 100 with a funnel 150 having a funnel opening 152 for funneling, herbs into the case 100, or the like. The funnel 150 may have a rectangular, oval, square, or round shape adapted to fit within the opening of the case 100 and funnel herb into the case 100. FIGS. 28A-N depict views of a case in accordance with embodiments of the present disclosure. FIGS. 29A-M depict views of a case in accordance with embodiments of the present disclosure.

FIGS. 30A-D depict views of a portion of a case 300 in accordance with embodiments of the present disclosure. In some embodiments, a case 300 may include a lid arm 350 extending from a lid of the case 300. The lid arm 350 may comprise a curved or hooked shape to enable the lid to rotate open and closed. The lid arm 350 may include an arm extension 352 extending horizontally from the lid arm 350 for seating within an arm holder 354. For example, the arm extension 352 may be a cylindrical pin sized to rotate about an axis when seated within the arm holder 354. The arm holder 354 may comprise a curved interior surface for accepting the arm extension 352 and allowing the lid to rotate open and closed. In this configuration, the back of the lid has no external hinge pieces and the portion of the case where the lid meets outer wall of the case is a flat plane with no protrusions. One advantage of this design is that there is no external hinge pieces protruding from the back of the case. As such, this design lowers the risk of the case getting caught on a thread, fabric, or the like, when inserted into, or removed from, a pocket or other storage area.

FIGS. 31A-D depict views of a portion of a case 400 in accordance with embodiments of the present disclosure. In some embodiments, the case 400 may comprise a first arm 460 attached to the outer wall of the case, and a second arm 462 attached to the lid of the case. In this example, the second arm 462 may comprise an extension or pin, or there may be a separate pin for attaching the first arm 460 and the second arm 462 rotatably about an axis, thereby allowing the lid of the case 400 to rotate open and closed. The back of the case (see FIG. 31B) comprises a flat plane, wherein the second arm 462 may be flush with the outer wall. When the lid is closed in this design, the second arm 462 is adjacent to the outer wall surface so that they are substantially level or even with each other, without any protrusions or indentations. The second arm 462 and the outer wall of the case may fit seamlessly together, creating a smooth and continuous appearance and tight seal to the central compartment.

FIGS. 32A-D depict views of a portion of a case 500 in accordance with embodiments of the present disclosure. In some embodiments, a case 500 may include a center arm 570 attached to a lid disposed between two side arms 572 attached to the outer wall of the case, the arrangement for allowing the lid to rotate open and closed. The center arm 570 may sit between and be attached to the side arms 572 and be rotatably attached to the side arms 572 via a pin, extensions from the center arm 570, or the like.

In certain embodiments, variations of the case design may incorporate features tailored to specific user preferences or operational requirements. These may encompass the absence of a spring-loaded lid mechanism, or larger inset magnets or clips for secure closure. Furthermore, to prevent accidental displacement, an extended track for the bottom panel may be implemented, ensuring stability and preventing unintended sliding. A modified cleaning tool may feature a shovel with a curved tip, enhancing debris removal and facilitating more effective cleaning and maintenance processes. Moreover, a pipe may incorporate micro-textures such as bumps or lines on specific materials to enhance heat dissipation and improve user comfort during operation. In some embodiments a case system may comprise a case in accordance with exemplary embodiments and a funnel for loading herb into the *cannabis* compartment, or the like. The funnel may comprise a wider mouth portion and a narrower insert portion sized to fit snuggly within an opening of the *cannabis* compartment, or the like. In embodiments of the present disclosure, a case may comprise engravable portions. For example, a user may wish to engrave a message, such as "Happy Birthday," on a portion of the case. The case may be engravable on all sides.

The above description is of a small number of embodiments for implementing the invention and is not intended to be limiting in scope. One of skill in this art will immediately envisage the methods and variations used to implement this invention in other areas than those described in detail.

In the disclosure and the claims, terms such as "first", "second", "third", "fourth", and the like, if any, will be used to distinguish similar components from each other and be used to describe a specific sequence or a generation sequence, but is not necessarily limited thereto. It will be understood that these terms are compatible with each other under an appropriate environment so that exemplary embodiments of the present invention set forth herein may be operated in a sequence different from a sequence illustrated or described herein. Likewise, in the case in which it is described herein that a method includes a series of steps, a sequence of these steps suggested herein is not necessarily a sequence in which these steps may be executed. That is, any described step may be omitted and/or any other step that is not described herein may be added to the method.

Here, the phrases "in an exemplary embodiment" or "in one embodiment" are not necessarily limited to one specific embodiment and may be applied to more than one embodiment. In addition, in the disclosure and the claims, terms such as "connected", "connecting", "linked", "linking", "coupled", "coupling", and the like, and various modifications of these terms may be used as the meaning including that one component is directly connected to another component or is indirectly connected to another component through the other component.

In addition, terms used in the present disclosure are for explaining exemplary embodiments rather than limiting the present invention. In the present disclosure, a singular form includes a plural form unless explicitly described to the contrary. Components, steps, operations, and/or elements mentioned by terms "comprise" and/or "comprising" used in the disclosure do not exclude the existence or addition of one or more other components, steps, operations, and/or elements.

Hereinabove, the present invention has been described with reference to exemplary embodiments thereof. All exemplary embodiments and conditional illustrations disclosed in the present disclosure have been described to intend to assist in the understanding of the principle and the concept of the present invention by those skilled in the art to which the present invention pertains. Therefore, it will be understood by those skilled in the art to which the present invention pertains that the present invention may be implemented in modified forms without departing from the spirit and scope of the present invention.

Therefore, exemplary embodiments disclosed herein should be considered in an illustrative aspect rather than a restrictive aspect. The scope of the present invention should be defined by the claims rather than the above-mentioned description, and equivalents to the claims should be interpreted to fall within the present invention.

While the foregoing is directed to embodiments of the present invention, other and further embodiments of the invention may be devised without departing from the basic scope thereof. For example, although numerous embodiments having various features have been described herein, combinations of such various features in other combinations not discussed herein are contemplated within the scope of embodiments of the present invention.

What is claimed is:

1. A hand-held case comprising:

a central compartment defined by an outer wall;

a top lid comprising a cover for covering the central compartment, the top lid movable from a closed position to an open position;

a bottom lid for covering a bottom compartment;

a pipe compartment housing a pipe, the pipe having a tapered center for allowing a user to grip the pipe;

wherein the top lid attached to the wall with a hinge; and wherein when the top lid is in a closed position, the hinge sits flush against the outer wall.

2. The hand-held case of claim 1, wherein the bottom lid comprises a slidable cover.

3. The hand-held case of claim 1, further comprising a tool compartment for storing a tool, the tool compartment disposed on a lateral side of the central compartment.

4. The hand-held case of claim 1, the top lid further comprising a magnet for securing the lid to the outer wall when the top lid is in the closed position, wherein the magnet is disposed on the cover in a position adjacent to the side wall when the top lid is in the closed position.

5. The hand-held case of claim 1, the top lid further comprising a seal on an interior surface of the lid adjacent the central compartment when the top lid is in the closed position, the seal making the inside of the central compartment substantially airtight when the top lid is in a closed position.

6. The hand-held case of claim 1, further comprising a grip comprising grooves for allowing a user to move the top lid between the closed position and the open position.

7. The hand-held case of claim 1, further comprising a tool, the tool adapted to scoop out the smokable herb from the central compartment, compact the smokable herb, and clean the central compartment.

8. The hand-held case of claim 1, wherein the pipe comprises a pipe filter slot for storing a filter, the filter adapted to filter a smokable herb.

9. The hand-held case of claim 1, wherein the pipe is spring loaded with a spring at the bottom of the pipe compartment, wherein the pipe partially exits the pipe compartment when the top lid is moved from the closed position to the open position, and the top lid compresses the pipe against the spring when the top lid is the closed position.

10. The hand-held case of claim 1, wherein the bottom compartment comprises at least one filter compartment for storing one or more filters for use with a pipe.

11. The hand-held-case of claim 10, further comprising one or more filters for use with the pipe, the one or more filters stored within the at least one filter compartment.

12. The hand-held case of claim 11, wherein the one or more filters comprise an opening for accepting a smokable herb and a rounded bottom portion for seating within the pipe.

13. The hand-held case of claim 11, further comprising a funnel for seating within an opening at the top of the central compartment and allowing a smokable herb to be transferred into the central compartment.

14. A hand-held case comprising:

a central compartment defined by an outer wall, the central compartment sized to accept a smokable herb;

a top lid comprising a cover for covering the central compartment, the top lid movable from a closed position to an open position, the top lid attached to the wall with a hinge;

a bottom lid comprising a slidable cover for covering a bottom compartment;

a tool compartment for storing a tool, the tool compartment disposed on a lateral side of the central compartment;

a tool, the tool adapted to scoop out the smokable herb from the central compartment; and a pipe compartment for storing a pipe, the pipe compartment disposed on an opposite lateral side of the central compartment from the tool compartment.

15. The hand-held case of claim 14, wherein the top lid further comprises a magnet for securing the lid to the outer wall when the top lid is in the closed position.

16. The hand-held case of claim 14, further comprising a tool further adapted to compact the smokable herb and clean the central compartment.

17. The hand-held case of claim 14, further comprising a pipe with a tapered center for allowing a user to grip the pipe, the pipe for smoking a smokable herb, the pipe comprising filter slot for storing a pipe filter, the filter adapted to filter the smokable herb.

18. A hand-held case comprising:

a central compartment defined by an outer wall;

a top lid comprising a cover for covering the central compartment, the top lid movable from a closed position to an open position;

a bottom lid for covering a bottom compartment, the bottom compartment comprising at least one filter compartment for storing one or more filters for use with a pipe;

a filter for use with a pipe, the filter stored within the at least one filter compartment;

wherein the top lid attached to the wall with a hinge; and wherein when the top lid is in a closed position, the hinge sits flush against the outer wall.

* * * * *